US011911650B1

(12) United States Patent
Liu

(10) Patent No.: US 11,911,650 B1
(45) Date of Patent: Feb. 27, 2024

(54) MULTIFUNCTIONAL FITNESS FRAME WITH REVERSIBLE PEDAL STRUCTURE

(71) Applicant: Bin Liu, Ningbo (CN)

(72) Inventor: Bin Liu, Ningbo (CN)

( * ) Notice: Subject to any disclaimer, the term of this patent is extended or adjusted under 35 U.S.C. 154(b) by 0 days.

(21) Appl. No.: 18/212,728

(22) Filed: Jun. 22, 2023

(51) Int. Cl.
*A63B 21/00* (2006.01)

(52) U.S. Cl.
CPC ..... *A63B 21/4035* (2015.10); *A63B 21/4034* (2015.10); *A63B 2209/00* (2013.01)

(58) Field of Classification Search
CPC ..... A63B 21/4035; A63B 21/4034; A63B 2209/00; A63B 21/16; A63B 21/0557; A63B 21/4029; A63B 23/03525; A63B 1/00; A63B 21/0628; A63B 21/0724; A63B 21/078; A63B 21/154; A63B 2225/10; A63B 21/06; A63B 21/068; A63B 3/00; A63B 9/00; A63B 21/00; A63B 23/03558; A63B 21/062; A63B 17/00; A63B 17/02; A63B 17/04; A63B 2022/0082; A63B 21/00047; A63B 21/0622; A63B 21/0624; A63B 21/0626; A63B 21/0783; A63B 21/4031; A63B 21/4033; A63B 22/0087; A63B 22/0089; A63B 2210/00; A63B 2210/50; A63B 22/0076–2022/0079; A63B 21/0615; A63B 21/08; A63B 21/4047; A63B 22/06–0694; A63B 71/0036
See application file for complete search history.

(56) References Cited

U.S. PATENT DOCUMENTS

| | | | | |
|---|---|---|---|---|
| 3,850,430 | A * | 11/1974 | Hamilton | A63B 21/0615 482/97 |
| 6,196,954 | B1 * | 3/2001 | Chen | A63B 22/203 D21/676 |
| 6,398,699 | B1 * | 6/2002 | Yang | A63B 22/14 482/52 |
| 6,709,368 | B1 * | 3/2004 | Chue | A63B 21/015 482/52 |
| 9,662,536 | B1 * | 5/2017 | Lin | A63B 21/4033 |
| 10,426,991 | B2 * | 10/2019 | Barnett | A63B 21/0552 |
| 11,614,796 | B1 * | 3/2023 | Summit | A63F 13/245 345/633 |
| 2020/0023231 | A1 * | 1/2020 | Hsieh | A63B 22/0076 |
| 2020/0094096 | A1 * | 3/2020 | Sorin | A63B 21/4047 |
| 2020/0222745 | A1 * | 7/2020 | Leipheimer | A63B 23/03525 |
| 2023/0077418 | A1 * | 3/2023 | Qiu | A63B 21/15 482/72 |

* cited by examiner

*Primary Examiner* — Megan Anderson
*Assistant Examiner* — Catrina A Letterman
(74) *Attorney, Agent, or Firm* — Jose Cherson Weissbrot

(57) ABSTRACT

The present invention provides a multifunctional fitness frame with a reversible pedal structure, which comprises a main frame, a pull ring arranged on the main frame and a pedal arranged on the main frame, wherein the pedal is arranged on the main frame in a reversible manner, and a support tube and a rotating shaft are also penetrated on the main frame; the pedal is turned over by the rotating shaft and leans against the support tube to facilitate the user to practice paddling; and the pedal can also be turned over and leaned against the ground by the rotating shaft to realize storage, so that the user can practice other actions conveniently.

7 Claims, 6 Drawing Sheets

MULTIFUNCTIONAL FITNESS FRAME WITH REVERSIBLE PEDAL STRUCTURE

TECHNICAL FIELD

The present invention relates to the technical field of fitness equipment, in particular to a multifunctional fitness frame with a reversible pedal structure.

BACKGROUND

Fitness frame is the equipment for trainers to train various movements. In order to meet the training needs of trainers for different muscle groups of the body, the functions of fitness frames tend to be diversified. In the prior art, multifunctional fitness frames are equipped with fixed pedals on the main frame, and various forms of exercise are carried out by using the pedals.

For example, U.S. Patent No. 20200222745 discloses an exercise machine, which includes a support frame with a first and second column; a plurality of guide members movably mounted along both columns; and at least one attachment detachably mounted onto the either column, thereby securing the at least one attachment to the support frame. The at least one attachment may include a first portion; a second portion extending from the first portion; and a locking mechanism extending from the second portion. The locking mechanism may include at least one stationary locking pin received by either column; and a movable locking pin configured to be received by either column. The at least one attachment is detachably mounted onto the either column simultaneously with the plurality of guide members, and at least one of the plurality of guide members positions an operative portion of a weight arrangement at a location along the support frame.

The fitness machine in this solution uses the accessory pedal to train muscle strength. However, the angle between the pedal and the fitness machine in this solution is fixed, so the user needs to sit and step on the pedal panel, and practice paddling by pulling the pull ring with hand force. When the user wants to do other forms of exercise, he will be disturbed by the pedal. For example, when the user wants to stand and do stretching exercise in elastic belt, the pedal with a fixed angle will interfere with elastic belt's stretching exercise, which will make the user's exercise process not smooth and reduce it.

Based on the above problems, it is necessary to put forward a brand-new multifunctional fitness equipment, which can use the pedal to do paddling training in sitting position, and when elastic belt stretching training in standing position is needed, the pedal will not interfere with it, so as to improve the smoothness of exercise and further enhance the user's experience.

SUMMARY

The present invention provides a multifunctional fitness frame with a reversible pedal structure, which comprises a main frame, a pull ring arranged on the main frame and a pedal arranged on the main frame, wherein the pedal is arranged on the main frame in a reversible manner, and a support tube and a rotating shaft are also penetrated on the main frame; the pedal is turned over by the rotating shaft and leans against the support tube to facilitate the user to practice paddling; and the pedal can also be turned over and leaned against the ground by the rotating shaft to realize storage, so that the user can practice other actions conveniently.

BRIEF DESCRIPTION OF DRAWINGS

In order to explain the technical solution of this application more clearly, the drawings needed in the implementation will be briefly introduced below. Obviously, the drawings described below are only some implementations of this application. For those skilled in the art, other drawings can be obtained according to these drawings without creative work.

In the figures.

Figure 1:
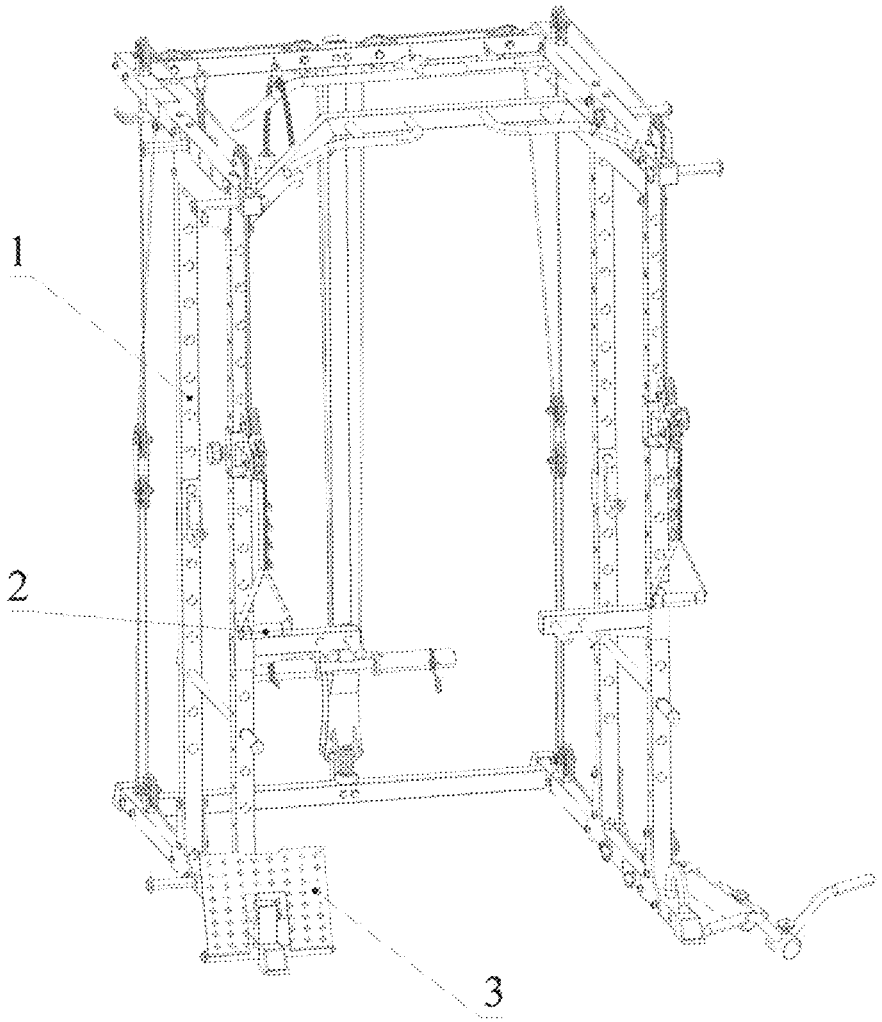
FIG. 1 is a schematic diagram of a multifunctional fitness frame with a reversible pedal structure provided by the present invention.

1, Main frame; 11, Pedal mounting part; 111, Through hole; 112, Pivot hole; 2, Pull ring; 3, Pedal; 4, Support tube; 41, Shoulder; 5, Spring clip; 6, Rotating shaft; 7, Gasket; 8, Bolt; 9, Anti-skid protrusion.

DESCRIPTION OF EMBODIMENTS

In the following, the technical solution in the embodiment of the application will be clearly and completely described with reference to the drawings in the embodiment of the application. Obviously, the described embodiment is only a part of the embodiment of the application, but not the whole embodiment. Based on the embodiments in this application, all other embodiments obtained by ordinary technicians in this field without creative labor belong to the protection scope of this application.

Reference to "an example" or "an embodiment" herein means that a particular feature, structure or characteristic described in connection with an embodiment or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification, and can be replaced appropriately according to the situation.

As shown in FIG. 1 to FIG. 6, the present invention provides a multifunctional fitness frame with a reversible pedal structure, which includes a main frame (1), a pull ring (2) arranged on the main frame (1) and a pedal 3 arranged on the main frame 1, wherein the pedal 3 is arranged on the main frame 1 in a reversible manner, and a support tube 4 and a rotating shaft 6 are also penetrated on the main frame 1; the pedal 3 is turned over by the rotating shaft 6 and leans against the support tube 4 so as to facilitate a user to practice paddling; the pedal 3 can also be turned over and leaned against the ground through the rotating shaft 6 to realize storage, so as to facilitate the user to practice other actions.

Figure 2:
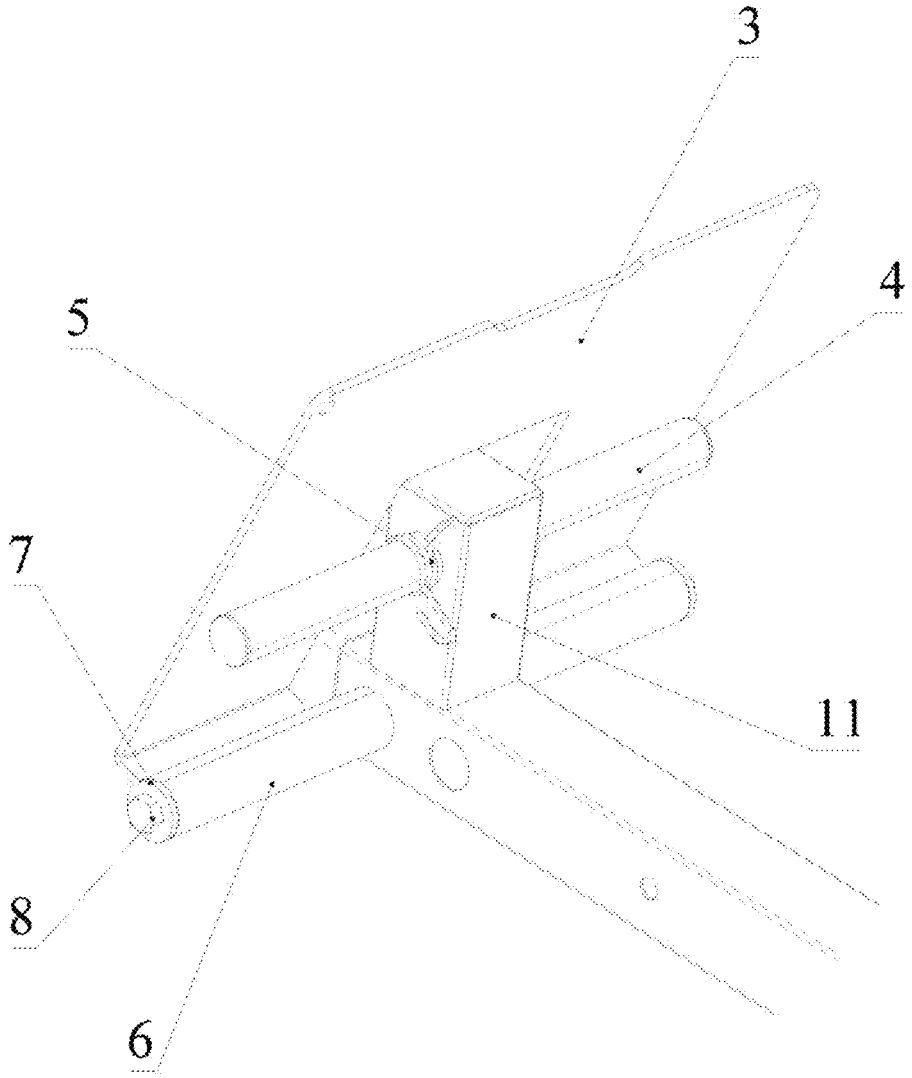
FIG. 2 is a pedal schematic diagram of a multifunctional fitness frame with a reversible pedal structure provided by the present invention.
Figure 3:
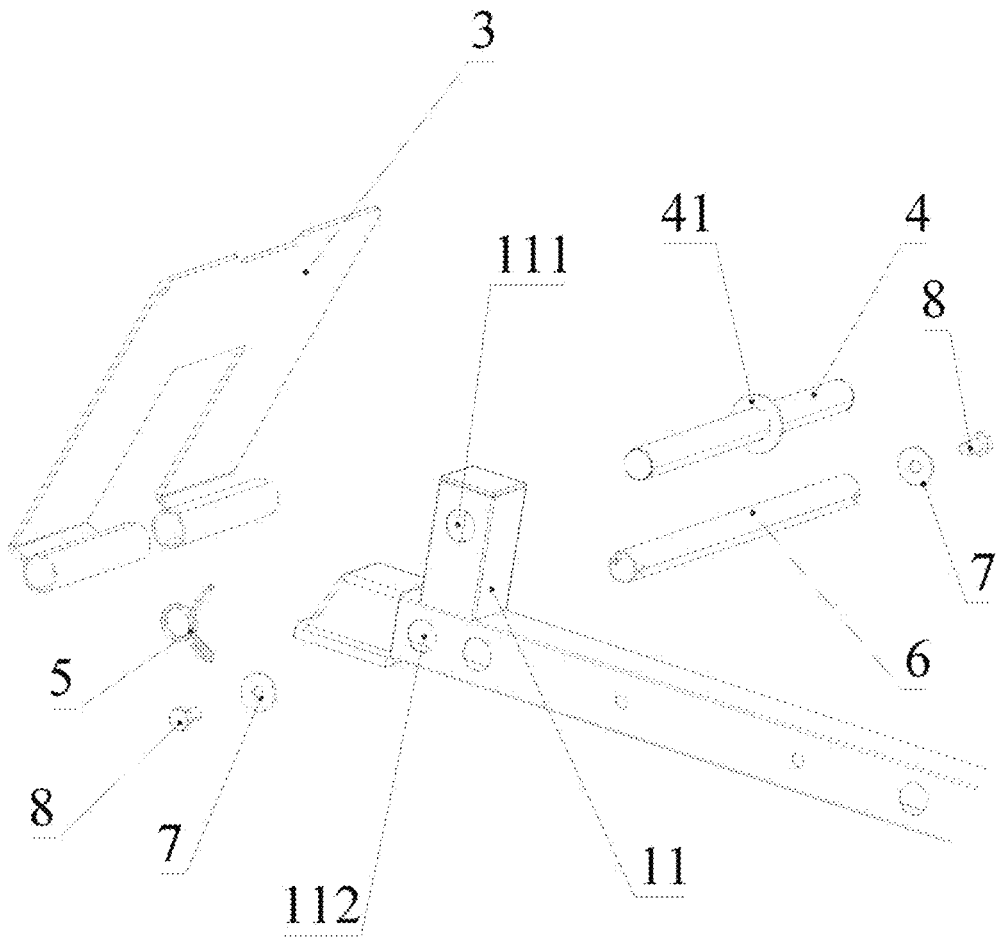
FIG. 3 is an explosion diagram of FIG. 2.
Figure 5:
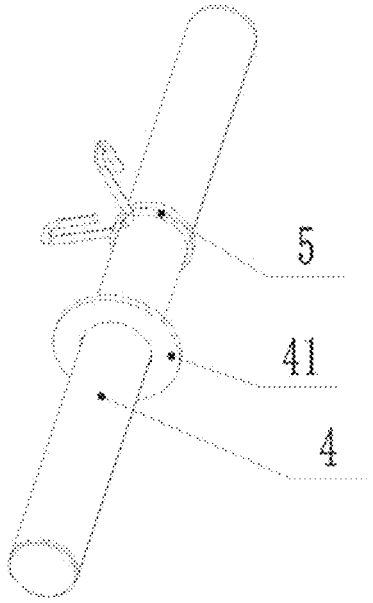
FIG. 5 is a schematic view of a support tube.

Specifically, as shown in FIGS. 2 and 3, the main frame 1 is provided with a pedal mounting part 11, and the pedal mounting part 11 is provided with a through hole 111 through which the support pipe 4 passes and a pivot hole 112 through which the rotating shaft 6 passes, wherein the pivot hole 112 is arranged below the through hole 111; as shown in FIGS. 3 and 5, the middle part of the support pipe 4 is provided with an integrally formed shoulder 41, and the support pipe 4 penetrates the main frame 1 and is buckled with a spring clip 5 at a penetrating position. During assembly, the support tube 4 passes through the through hole 111 and protrudes from the other end, and the shoulder 41 abuts on the pedal mounting part 11. At this time, the spring clip 5 penetrates at the other end of the support tube 4 and abuts on the pedal mounting part 11, and the support tube 4 is stably mounted on the pedal mounting part 11 by the shoulder 41 and the spring clip 5.

Figure 6:
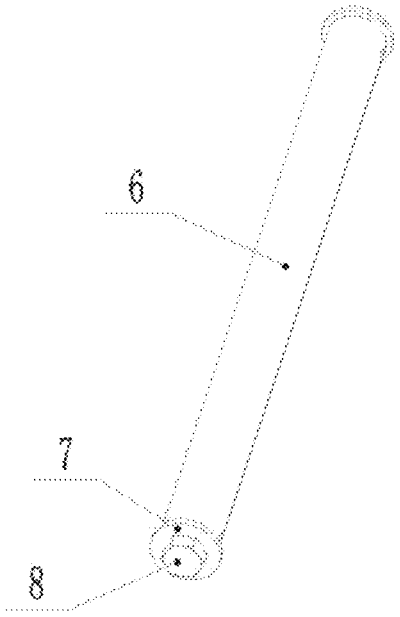
FIG. 6 is a schematic view of a rotating shaft.

As shown in FIGS. 3 and 6, the rotating shaft 6 passes through the pivot hole 112, the pedals 3 are sleeved at both ends of the rotating shaft 6; both ends of the rotating shaft 6 are provided with bolts 8 and gaskets 7 to limit the relative positions of the rotating shaft 6 and the pedals 3, and the pedals 3 are firmly installed on the pedal mounting part 11.

Figure 4:
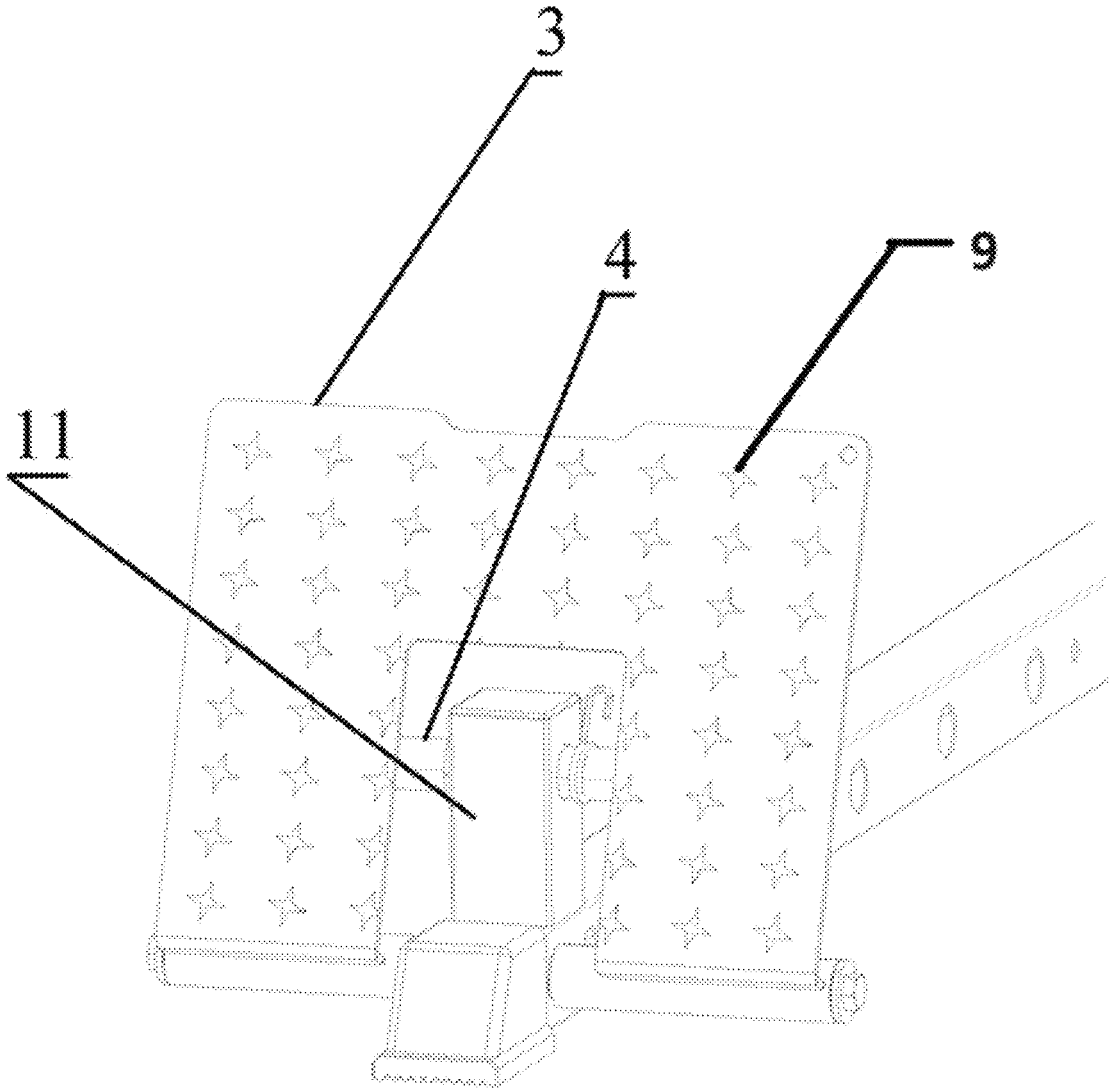
FIG. 4 is another pedal schematic diagram of a multifunctional fitness frame with a reversible pedal structure provided by the present invention.

When a user needs to practice paddling in a sitting posture, the pedal 3 is turned over and leans against the support tube 4 at a certain angle relative to the ground, and the user can put his feet on the pedal 3 and pull the pull ring 2 to practice paddling. As a preferred embodiment of the present invention, as shown in FIG. 4, a plurality of anti-skid protrusions 9 are formed on the outer surface of the pedal 3, and the plurality of anti-skid protrusions 9 are distributed in a linear array or a circumferential array along the center of the pedal 3, so that the anti-skid protrusion 9 covers the outer surface of the pedal 3, and the user's feet are not easy to slip off the pedal 3 during contact. In this embodiment, the anti-skid protrusion 9 is preferably configured to be made of a rubber material, and in other embodiments, the anti-skid protrusion 9 can also be made of other materials with anti-skid effect.

When paddling training is not needed, the user can flip the pedal 3 and allow it to lean on the ground, thus making room for the flip of the pedal 3, so that the user can pull the pull ring 2 to train other movements in the standing posture.

The present invention provides a multifunctional fitness frame with a reversible pedal structure, wherein the reversible pedal is arranged on the main frame of the multifunctional fitness frame, and when paddling action training is not needed, the pedal is turned to lean on the ground, so that space is made up, other actions are not affected, and the user experience is greatly improved.

The technical means disclosed in the solution of the present invention are not limited to the technical means disclosed in the above embodiments, but also include the technical solution composed of any combination of the above technical features. It should be pointed out that for those skilled in the art, several improvements and embellishments can be made without departing from the principle of the present invention, and these improvements and embellishments are also regarded as the protection scope of the present invention.

What is claimed is:

1. A multifunctional fitness frame with a reversible pedal structure, comprising: a main frame (1), a pull ring (2) arranged on the main frame (1), and a pedal (3) arranged on the main frame (1), wherein the pedal (3) is arranged on the main frame (1) in a reversible manner, and a support tube (4) and a rotating shaft (6) are penetrated on the main frame (1); the pedal (3) is rotated around the rotating shaft (6) and leans against the support tube (4) so as to facilitate a user to practice paddling; the pedal (3) is also rotated around the rotating shaft and leaned against the ground through the rotating shaft (6) to realize storage, so as to facilitate the user to practice other actions.

2. The multifunctional fitness frame with the reversible pedal structure according to claim 1, wherein the main frame (1) further comprises a pedal mounting part (11), and the pedal mounting part (11) is further provided with a through hole (111) and a pivot hole (112).

3. The multifunctional fitness frame with the reversible pedal structure according to claim 2, wherein the support tube (4) penetrates and is fixed in the through hole (111), and the rotating shaft (6) penetrates and is pivotally installed in the pivot hole (112).

4. The multifunctional fitness frame with the reversible pedal structure according to claim 3, wherein a middle part of the support tube (4) is provided with an integrally formed shoulder (41), and the support tube (4) penetrates the main frame (1) and is buckled with a spring clip (5) at a penetrating position.

5. The multifunctional fitness frame with the reversible pedal structure according to claim 4, wherein the pedal (3) is sleeved on both ends of the rotating shaft (6), and both ends of the rotating shaft (6) are provided with bolts (8) and gaskets (7) to limit relative positions of the rotating shaft (6) and the pedal (3).

6. The multifunctional fitness frame with the reversible pedal structure according to claim 5, wherein a plurality of anti-skid protrusions (9) are formed on an outer surface of the pedal (3), and the plurality of anti-skid protrusions (9) are distributed in a linear array or a circumferential array along a center of the pedal (3).

7. The multifunctional fitness frame with the reversible pedal structure according to claim 6, wherein the plurality of anti-skid protrusions (9) are made of a rubber material.

* * * * *